US009723907B2

(12) United States Patent
Huang et al.

(10) Patent No.: US 9,723,907 B2
(45) Date of Patent: Aug. 8, 2017

(54) REFILLABLE LIPSTICK WITH RETRACTABLE SLEEVE

(71) Applicants: Kuo Yu Huang, Guangzhou (CN); Zoilo Luis Alviar, Everett, WA (US)

(72) Inventors: Kuo Yu Huang, Guangzhou (CN); Zoilo Luis Alviar, Everett, WA (US)

( * ) Notice: Subject to any disclaimer, the term of this patent is extended or adjusted under 35 U.S.C. 154(b) by 0 days.

(21) Appl. No.: 14/913,977

(22) PCT Filed: May 30, 2014

(86) PCT No.: PCT/CN2014/078876
§ 371 (c)(1),
(2) Date: Feb. 23, 2016

(87) PCT Pub. No.: WO2015/180115
PCT Pub. Date: Dec. 3, 2015

(65) Prior Publication Data

US 2017/0065056 A1 Mar. 9, 2017

(51) Int. Cl.

| | |
|---|---|
| ***A45D 40/20*** | (2006.01) |
| ***A45D 40/16*** | (2006.01) |
| ***A45D 40/06*** | (2006.01) |
| ***A45D 40/04*** | (2006.01) |
| ***A45D 40/14*** | (2006.01) |
| *A45D 40/00* | (2006.01) |

(52) U.S. Cl.
CPC ..... *A45D 40/16* (2013.01); *A45D 40/04* (2013.01); *A45D 40/06* (2013.01); *A45D 40/14* (2013.01); *A45D 2040/0043* (2013.01); *A45D 2040/0062* (2013.01)

(58) Field of Classification Search
CPC ..... A45D 40/16; A45D 40/04; A45D 40/14; A45D 2040/0031; A45D 2040/0043; A45D 2040/0056; A45D 2040/0062
See application file for complete search history.

(56) References Cited

U.S. PATENT DOCUMENTS 8,807,148 B2 * 8/2014 Hermouet ..... A45D 40/16 132/318
9,420,869 B2 * 8/2016 Huang ..... A45D 40/06

FOREIGN PATENT DOCUMENTS

KR WO 2014073819 A1 * 5/2014 ..... A45D 40/00

* cited by examiner

*Primary Examiner* — Jennifer C Chiang
(74) *Attorney, Agent, or Firm* — Timberline Patent Law Group

(57) ABSTRACT

A refillable lipstick is provided. In one implementation, a high-quality permanent lipstick dispenser incorporates a screw-type catch or a magnetic catch that enables replacement of the lipstick within the dispenser. Lipstick refills may be installed and removed from the dispenser with an extractor. In an implementation, the dispenser includes a sleeve that is arranged to extend and retract within the dispenser, to provide access to the lipstick for removal and/or installation.

21 Claims, 14 Drawing Sheets

REFILLABLE LIPSTICK WITH RETRACTABLE SLEEVE

BACKGROUND

Lipstick for adding color, texture, and protection to the lips has been available in cylindrical metal tubes since 1915. Classic problems with lipstick containers include losing the lipstick cap when the lipstick is jostled in a purse, and having the lipstick melt from the heat of the sun.

Lipstick tubes have improved to address some of these problems. However, a user conventionally must buy the lipstick dispensing tube with the lipstick, adding significant cost. The lipstick container has become so associated with the lipstick product it contains that the dispensing tube itself is also referred to as a "lipstick." The marketing of lipstick often becomes marketing of the dispenser tube. Since the cost of the lipstick and dispenser combination is relatively high, a manufacturer may limit the number of lipstick types or lipstick colors to be offered, to avoid an overstock of relatively expensive dispensers containing less popular lipstick colors or shade variations.

SUMMARY

A refillable lipstick is provided. In one implementation, a high-quality permanent lipstick dispenser incorporates a magnetic catch that enables replacement of the lipstick within the dispenser. In other implementations, the permanent lipstick dispenser includes a screw-type catch, a bayonet-type catch, or the like. In an implementation, a refill lipstick is packaged in a refill cap, or the like. In one aspect, the lipstick dispenser includes a retractable sleeve, which may be retracted to install, remove, or change a lipstick refill of a favorite dispenser.

In another aspect, lipstick refills may be installed and removed from the dispenser using an extractor. In an implementation, a swivel-up dispenser extends and retracts the lipstick. At extension, the user can retract the sleeve, which then provides an exposed area for accessing the lipstick from the dispenser for removal. Further, the exposed area can also be used to install a refill lipstick within an empty dispenser. A working cap is provided to cap the lipstick between refills. An exemplary kit contains a swivel-up dispenser, custom decorative outer shell and trim for the dispenser, one or more alternate lipsticks in one or more refill caps, one or more extractors, and a working cap.

This summary section is not intended to give a full description of a refillable lipstick, or to provide a list of features and elements. A detailed description of example embodiments follows.

DETAILED DESCRIPTION

Overview

Figure 1:
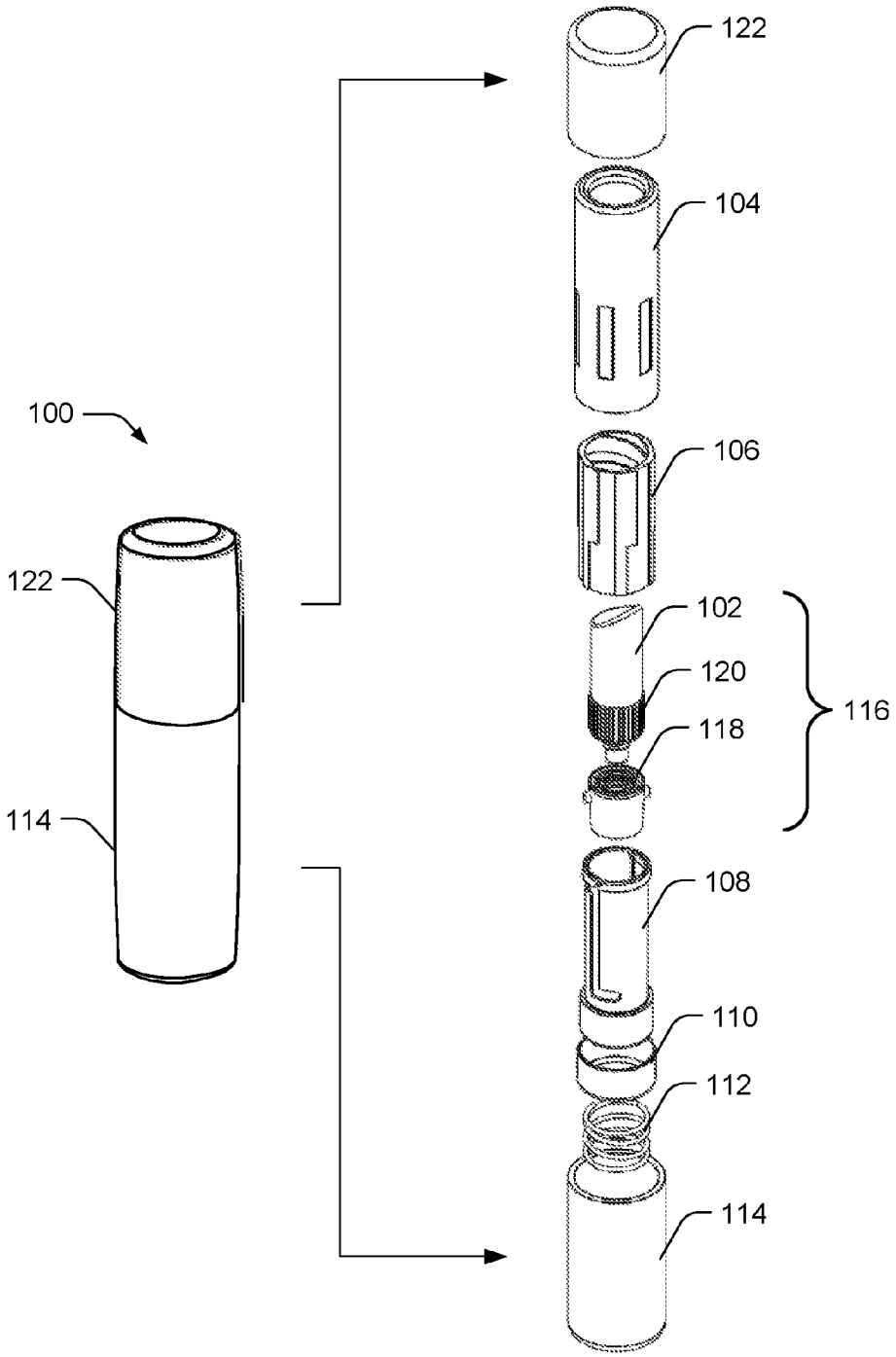
FIG. 1 is a diagram of an example refillable lipstick dispenser, according to one embodiment.

This disclosure describes an example refillable lipstick. In one implementation, an example refillable lipstick provides a high-quality, permanent, decorative lipstick dispenser that can be refilled with new lipsticks at will. The new lipsticks may be the same as the lipstick being refilled, or the refill may be of different composition, color, texture, gloss, flavor, and so forth, than the lipstick being replaced or refilled.

The example refillable lipstick reduces the cost of buying lipstick over time, and enables a manufacturer to offer a wider selection of lipstick colors, textures, and types. If a given lipstick is depleted or damaged, the tube dispenser does not have to be discarded, and a new lipstick tube dispenser does not have to be purchased. This saves resources and the environment, and can be economical for the lipstick user, while potentially providing the lipstick user with a high-quality lipstick dispenser that can be customized and ornamented as well as otherwise personalized.

The refillable lipstick dispenser incorporates a mechanism for holding and releasing a given lipstick. In an implementation, the holding mechanism is a magnetic catch that secures and enables replacement of the lipstick within the dispenser. Alternatively, a friction fit, bayonet fitting, reverse bayonet lock, or other technique may be used to hold and release a given lipstick. For example, in one embodiment, a screw-type fitting is used to secure the lipstick to the dispenser. In another example, the screw-type fitting is activated or deactivated by a three-quarters turn of the lipstick in the dispenser. In alternate embodiments, a one-quarter turn, one-half turn, full turn, or other similar sequence may be used.

For the purposes of this disclosure, a charge, portion, segment, or stick of lipstick (e.g., lipstick, lip balm, lip gloss, or other product) constituting a lipstick refill will be referred to herein simply as a "lipstick." In an implementation, a sleeve surrounds the lipstick within the dispenser, which may be retracted within the dispenser by a user, for example, to uncover a portion of the lipstick or the lipstick holder. This exposes the lipstick payload for access and removal by an extractor or other refill cap. Otherwise, when not in a retracted position, the sleeve surrounds the lipstick, giving protection to the lipstick. When stored within the dispenser or extended for use, the lipstick is held firmly by the refillable lipstick dispenser for extension, retraction, and application by the user.

Lipstick refills may be installed and removed from the dispenser with a refill cap, for example, by retracting the sleeve of the dispenser. Additionally, installation and/or removal of the lipstick from the dispenser may be performed with an extractor (with or without retracting the sleeve). Functionally, in one implementation, the extractor makes and/or breaks an attachment between the magnetic catch inside the decorative lipstick dispenser and a disposable magnetic cup holding the lipstick. The extractor is arranged to grip the lipstick, positioning it for installation or storing it for later use. Further, by using the extractor, a user can avoid contacting the lipstick and potentially damaging it through handling.

In an implementation, a swivel-up version of the dispenser extends and retracts the lipstick, securing the lipstick so that a refill may be made only when the lipstick is fully extended from the decorative dispenser. A top or "working cap" is provided to cap the lipstick between refills. The refillable lipstick may be provided in a kit that contains any combination of a swivel-up dispenser (with magnetic or screw-type catch, for example), custom decorative outer shells and trim for the dispenser, one or more alternate lipsticks in one or more refill caps, one or more extractors, and a working cap. In alternate implementations, an example kit may include fewer, additional, or alternative components.

Example Implementations

Figure 2:
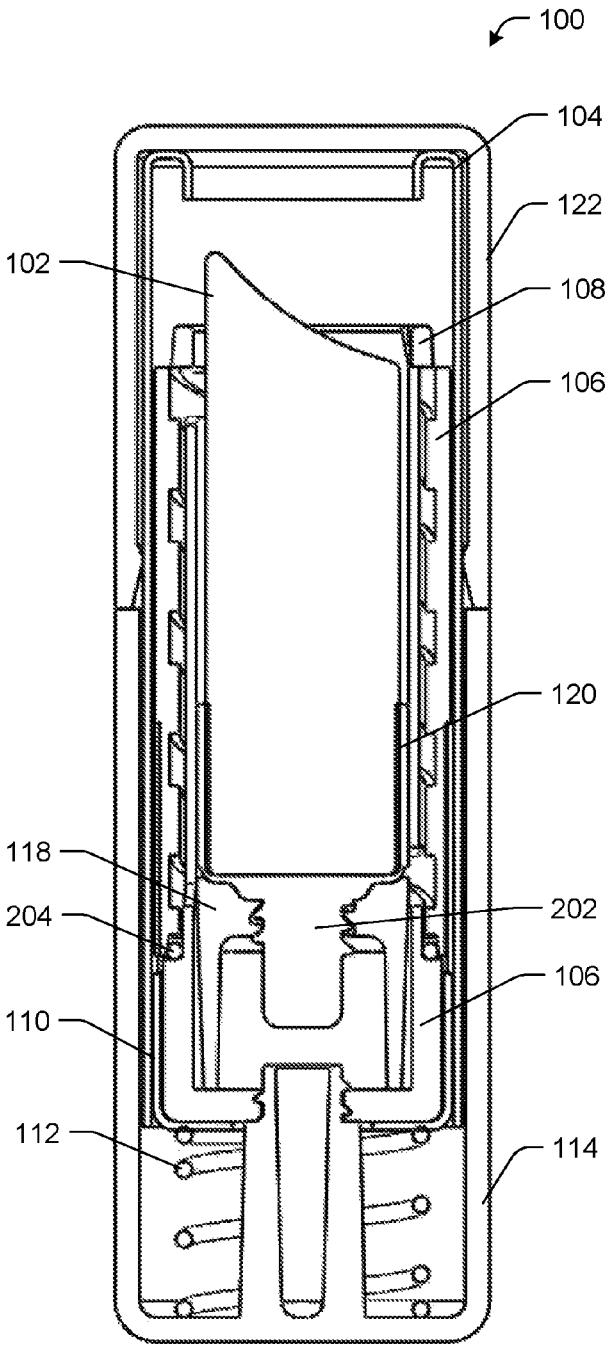
FIG. 2 is a cross-sectional view of the example refillable lipstick dispenser of FIG. 1, with the lipstick fully retracted and the working cap secured, according to an implementation.

FIG. 1 shows an example refillable lipstick dispenser 100, having a screw-type coupling, with integrated and exploded views. FIG. 2 is a cross-sectional view of the example refillable lipstick dispenser 100, with the lipstick fully retracted and the working cap secured, according to an implementation. Referring to FIGS. 1 and 2, an example refillable lipstick dispenser 100 has a swivel-up mechanism for containing and handling the lipstick 102. In an implementation, the swivel-up mechanism includes a retractable sleeve 104, a spiral sleeve 106, a tubular member 108, such as an inner guide sleeve, a spacer 110 or other grommet to space and to dampen twisting motions, a spring component 112, and an outer shell 114.

In an implementation, as shown in FIGS. 1, 2, 4, and 5, a moving payload 116 of the dispenser 100 consists of a carrier 118, cup 120, and the lipstick 102. In an implementation, each lipstick 102 is permanently inserted into a corresponding cup 120, which may have teeth, serrations, or other means for grasping the base of the lipstick 102. The carrier 118 rides in a rail or slot 802 (see FIG. 8) in the tubular member 108. For example, as a user twists the outer shell 114 (or otherwise actuates the dispenser 100), the carrier 118 is propelled upwards or downwards within the tubular member 108, via the spiral sleeve 106 and the rail or slot 802.

For example, in an implementation, the carrier 118 has pins that engage corresponding slots 802, rails, or keyways in the tubular member 108, shown as an inner guide sleeve. The spiral sleeve 106 has a second corkscrewed spiral slot, rail, or keyway on its inner surface that also engages the pins of the carrier 118. Thus, when the spiral sleeve 106 is rotated around the tubular member 108 (by twisting the outer shell 114, for example), the carrier 118 is raised or lowered by screw motion depending on the direction of rotation of the spiral sleeve 106. However, the carrier 118 only moves straight up and down because of the straight slots 802 of the tubular member 108.

The cup 120 grasps and holds the lipstick 102 and removably attaches to the carrier 118. Thus, installation or removal of a lipstick 102 from a dispenser 100 includes coupling or decoupling the cup 120 from the carrier 118, respectively. For example, in an implementation, the cup 120 is coupled to the carrier 118 via a screw or helix-type connection 202, as shown in FIG. 2. For example one of either the cup 120 and the carrier 118 may have a male component and the other of the cup 120 and the carrier 118 may have a female component, such that the cup 120 and the carrier 118 may be coupled and decoupled by a user, for example, to install and remove a lipstick refill (102), by rotating the cup 120 with respect to the carrier 118. In various embodiments, the amount of rotation used to couple or decouple the cup 120 and the carrier 118 may vary (e.g., ¼ turn, ⅓ turn, ½ turn, ⅔ turn, ¾ turn, 1 full turn, 1¼ turn, etc.). In alternate embodiments, a turn may be combined with a pull or a push (or the like) to couple or decouple the cup 120 and the carrier 118.

In various embodiments, as shown in FIG. 1, the cup 120 includes one or more features to facilitate in turning the cup 120. For example, the cup 120 may include one or more splines (as shown in FIG. 1), or like features (e.g., ridges, patterns, notches, tabs, grooves, etc.). In one example, the splines (or other features) may be engaged by a refill cap 302, an extractor 900, or like component, to turn the cup 120 with respect to the carrier 118, for coupling or decoupling the cup 120 to the carrier 118.

In another implementation, as shown in FIGS. 6-11, the moving payload 116 of the dispenser 100 includes a magnet or magnetized component 602. In the implementation, the cup 120 is coupled to the carrier 118 via a magnetic connection between the magnet 602 and the cup 120, which is fabricated from a magnetically attractive material (e.g., steel or iron alloy, etc.). In such an implementation, the cup 120 and the carrier 118 may be coupled or decoupled by a user, for example, to install or remove a lipstick refill (102), by making or breaking the magnetic connection between the cup 120 and the carrier 118/magnet 602. In one implementation, the carrier 118 may also be fabricated from a magnetically attractive material to enhance the magnetic coupling of the cup 120 and the carrier 118.

In an alternate embodiment, the cup 120 and the carrier 118 may be coupled and decoupled via a combination of features. For example, a magnetic catch may be combined with a screw-type connection 202, or the like. Further, one or more other types of catches, latches, or coupling mechanisms (e.g., snap fitting, arrowhead fitting, press fitting, etc.) may be used in various embodiments, either in combination with those described herein, or in other combinations.

A base cover or outer shell 114 fits over the bottom of the tubular member 108 and provides a customizable decorative shell for the lower part of the refillable lipstick dispenser 100. In various implementations, the outer shell 114 is twisted or rotated with respect to the tubular member 108 by a user to move the lipstick 102 out of the dispenser 100 for use or for replacement, or into the dispenser 100 for installation or for storage.

As shown in FIGS. 1 and 2, a dispenser 100 may also include a working cap 122 arranged to protect the lipstick 102 during handling, transport, etc. In an implementation, the working cap 122 attaches to the refillable lipstick dispenser 100 when the lipstick 102 is fully retracted into the tubular member 108. The working cap 122 may be decorative to match the design of the shell 114, for instance, and may be functionally rigid to provide protection to the lipstick 102 against potentially damaging contact with items in a pocket or purse, etc.

In various embodiments, the outer shell 114 and the working cap 122 (as well as other portions of the dispenser 100) may be customizable, or available in various decorative themes, colors, designs, and the like. For example, the outer shell 114 and the working cap 122 may be available in various shaped cross-sections (e.g., circular, elliptical, polygonal, etc.) and may be adorned (or customizable) with various patterns, colors, designs, embellishments, jewels, materials, and so forth, so as to be an attractive accessory for the user.

Figure 3:
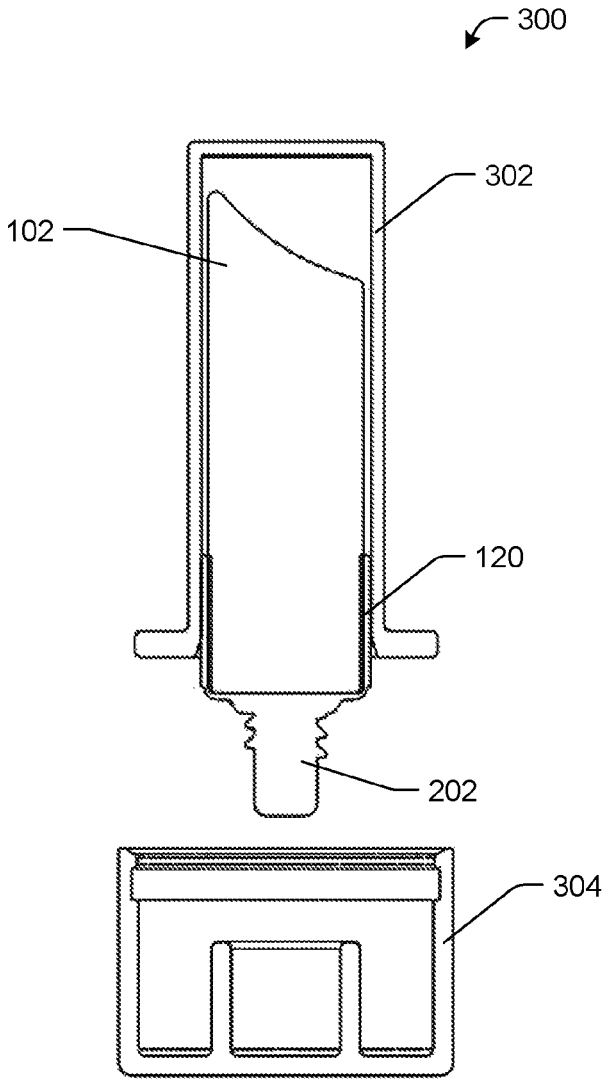
FIG. 3 is a cross-sectional view of an example lipstick refill, with associated packaging, according to an implementation.

FIG. 3 is a cross-sectional view of an example lipstick refill 300, with associated packaging, according to an implementation. For example, the lipstick refill 300 may be obtained by a user to replace a lipstick 102 in a dispenser 100. In various embodiments, the lipstick refill 300 may include a refill cap 302 and protective packaging 304, as well as a lipstick 102 and a replacement cup 120. In one embodiment, the refill cap 302 grips and holds the cup 120 to hold the lipstick 102 prior to installation of the lipstick 102 into a dispenser 100.

In an implementation, the example refill cap 302 is attachable to the refillable lipstick dispenser 100, such as to the outer shell 114, the sleeve 104, or to other parts of the example swivel-up mechanism. For example, in various embodiments, the refill cap 302 may be snapped onto the dispenser 100 during installation of the lipstick 102. In other embodiments, the refill cap 302 may be placed on, screwed on, or otherwise coupled to the dispenser during lipstick 102 installation. In an implementation, the refill cap 302 and/or the packaging 304 may be retained for storage of the lipstick 102, while other lipsticks 102 are used with the dispenser 100.

Figure 4:
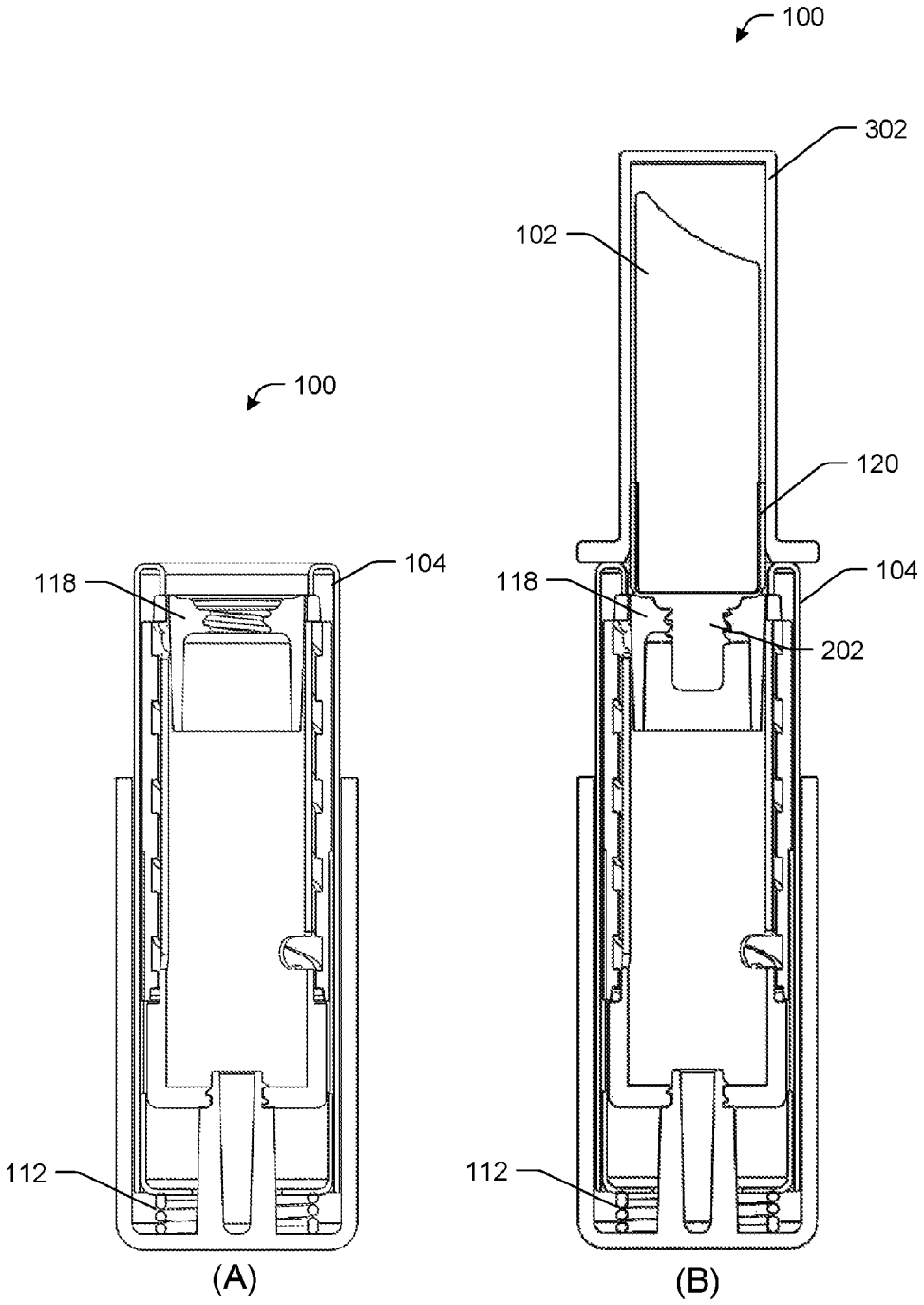
FIG. 4 shows (A) an example dispenser in preparation for installation of a lipstick refill, and (B) a lipstick refill in place on the dispenser and ready for installation, according to one embodiment.
Figure 5:
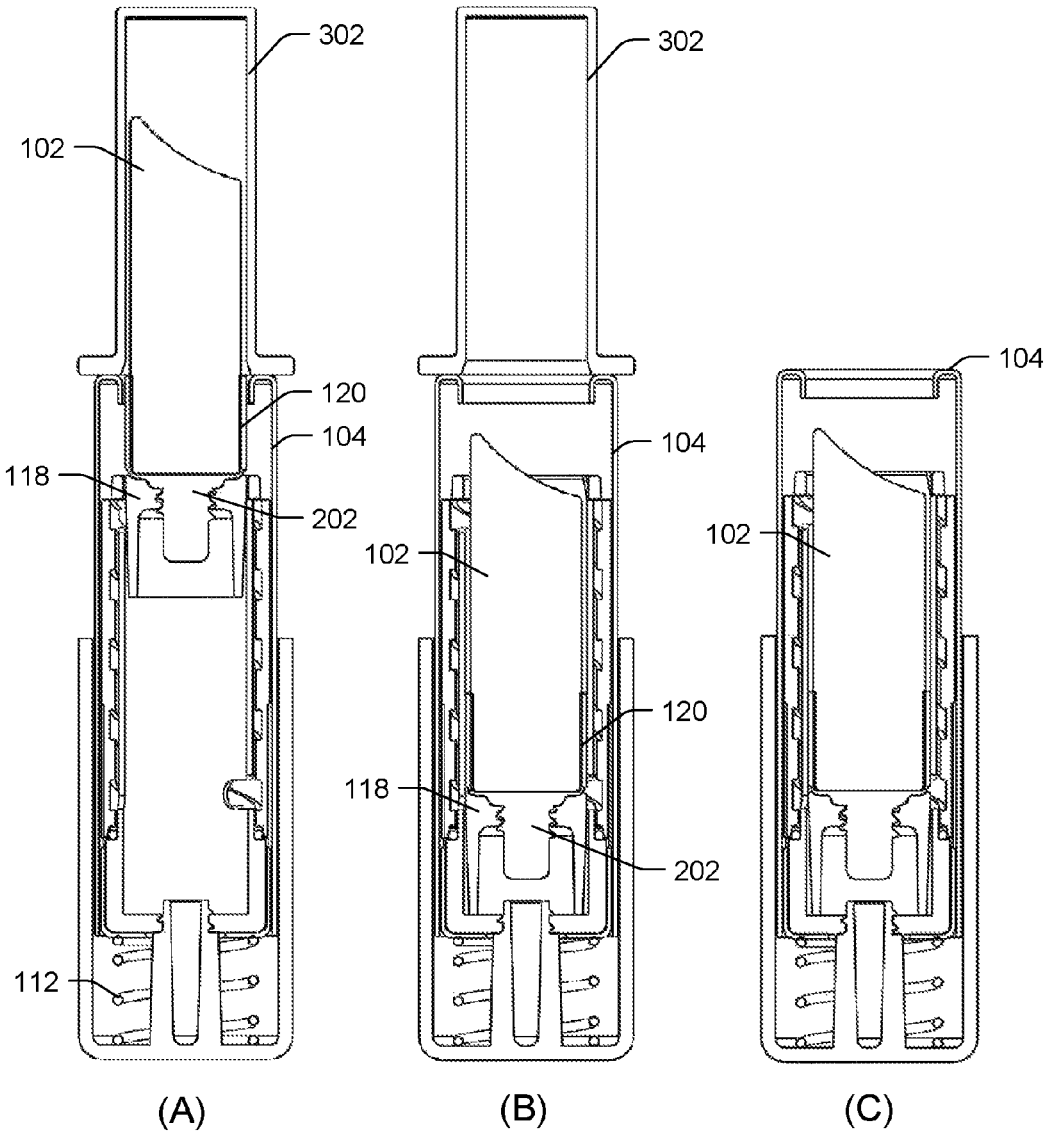
FIG. 5 shows the example dispenser of FIG. 4, in three views representing installation of the lipstick refill to the dispenser, according to the embodiment.

FIGS. 4 and 5 illustrate an example technique of installing a lipstick 102 into a dispenser 100, using a lipstick refill 300. In various embodiments, a similar technique may be used to install a lipstick 102 into a dispenser 100 using other refill devices or types (such as with an extractor 900, or various other devices, packages, etc.). Removal of a lipstick 102 from a dispenser 100 can be performed by following the technique in an opposite order as described herein, for example.

FIG. 4 shows (A) an example dispenser 100 in preparation for installation of a lipstick refill 300, and (B) a lipstick refill 300 in place on the dispenser 100 and ready for installation of a lipstick 102, according to one embodiment. As shown in FIG. 4(A), the carrier 118 may be positioned at the top of the dispenser 100 in preparation for installation of a lipstick 102. In one implementation, the sleeve 104 may be retracted to allow access to the carrier 118 during the installation. For example, as shown in FIG. 4, the sleeve 104 may be supported and spring-loaded in the dispenser 100 by the spring 112 (or like mechanism). In the example, retracting the sleeve 104 includes compressing the spring 112 within the dispenser 100 by sliding the sleeve 104 into the dispenser 100. When the sleeve 104 is slid into the dispenser 100, the carrier 118 is further exposed and accessible. In the example, when the sleeve 104 is released, the spring 112 expands, extending the sleeve 104 to the rest position (as shown in FIG. 5, for instance).

As shown in FIG. 4(B), the lipstick refill 300 can be placed (or coupled) to the dispenser 100, above the carrier 118. The cup 120 is coupled to the carrier 118, by screw-type connection 202, magnetic connection 602, or the like, as described above. For example, with a screw-type connection, the lipstick refill 300 may be rotated while it is in position on the dispenser 100. In various embodiments, the cup 120 is coupled to the carrier 118 while the sleeve 104 is retracted, providing access to the carrier 118 by the lipstick refill 300.

In the example, once the cup 120 is coupled to the carrier 118, the sleeve may be extended, as shown in FIG. 5(A), by releasing it, for example. As shown, the spring 112 expands, extending the sleeve 104 when the sleeve 104 is released. As also shown in FIG. 5(A), when the sleeve 104 extends, it pushes the refill cap 302 upward relative to the lipstick 102, releasing contact of the refill cap 302 with the cup 120.

As shown in FIG. 5(B), with the cup 120 coupled to the carrier 118, and the sleeve 104 retracted, the movable payload 116 (including the lipstick 102) may be lowered into the dispenser 100. This removes the lipstick 102 from the refill cap 302, and stores the lipstick 102 within the dispenser 100 for later use. After removing the lipstick 102 from the refill cap 302, the refill cap 302 is removed from the dispenser 100, as shown in FIG. 5(C). The newly installed lipstick 102 may be stored in the dispenser 100 (and working cap 122 placed on the dispenser 100) or may be used by extending the lipstick 102 from the dispenser 100.

Figure 6:
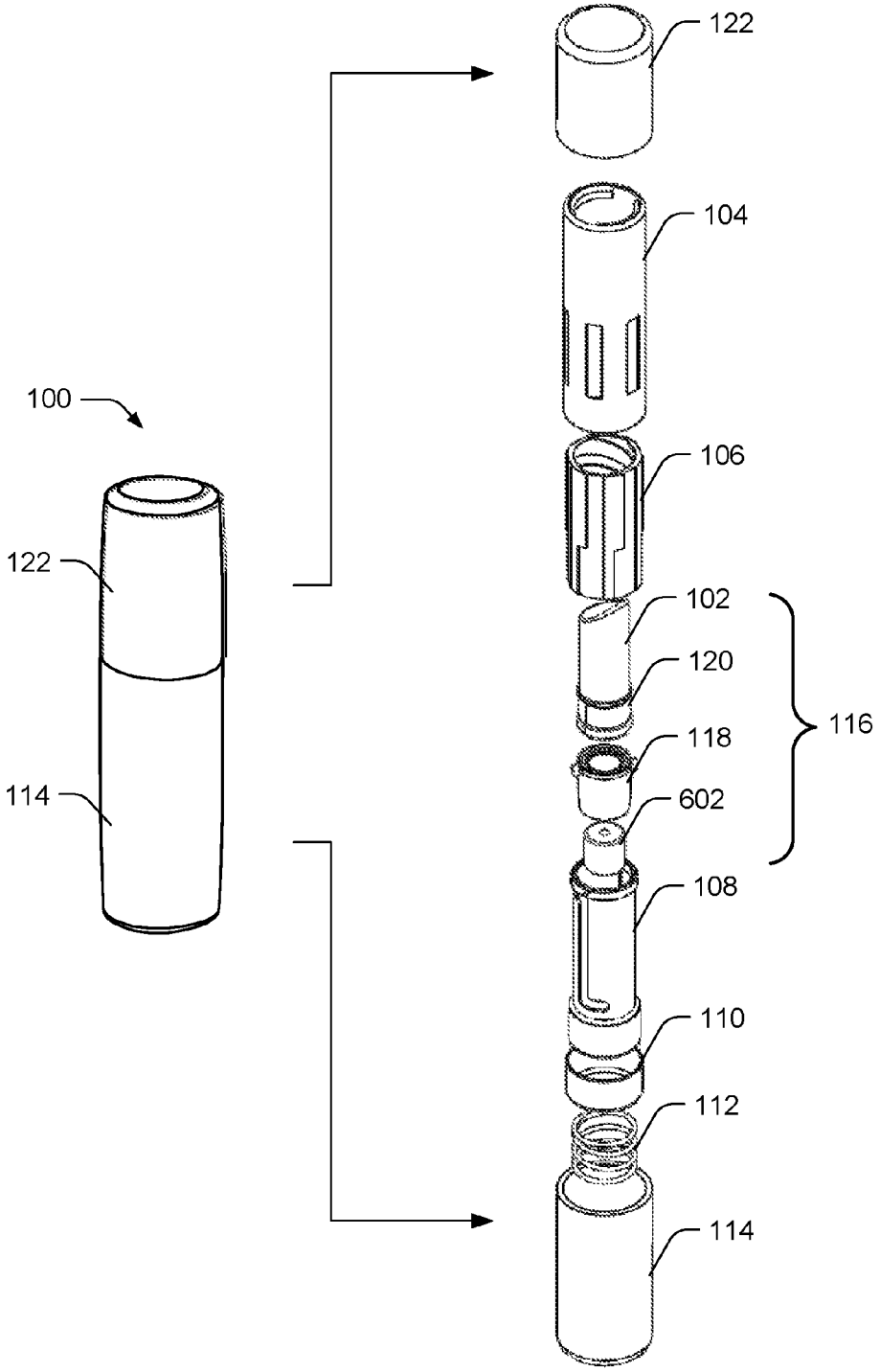
FIG. 6 is a diagram of an example refillable lipstick dispenser, according to another embodiment.
Figure 7:
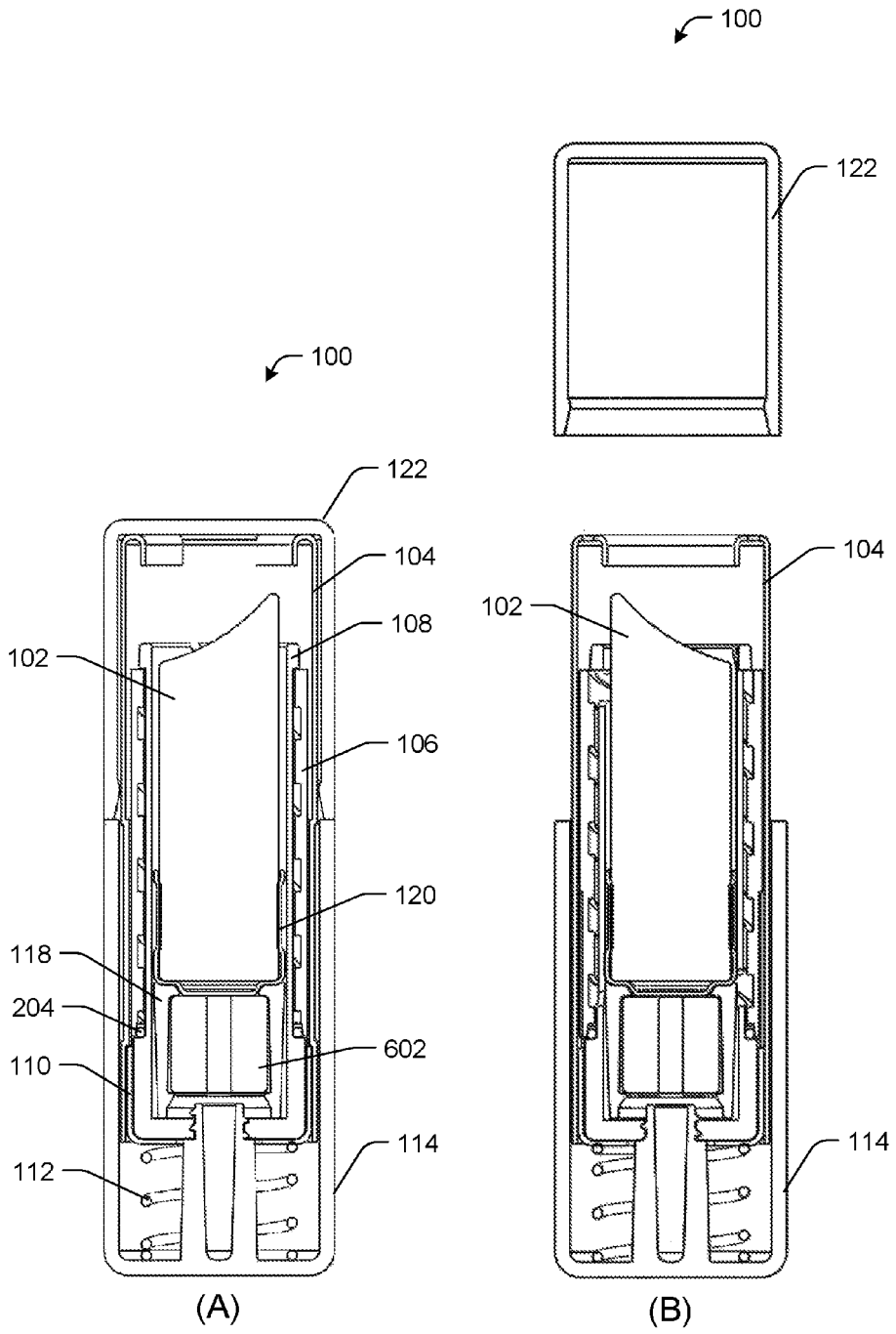
FIG. 7 includes two cross-sectional views of the example refillable lipstick dispenser of FIG. 6, with and without the working cap, according to an implementation.

FIG. 6 shows another example refillable lipstick dispenser 100, having a magnetic-type coupling, with integrated and exploded views. FIG. 7 includes two cross-sectional views of the example refillable lipstick dispenser of FIG. 6, with and without the working cap 122, according to an implementation. As shown in FIGS. 6 and 7, in various implementations, the dispenser 100 of FIGS. 6 and 7 is functionally identical to the dispenser 100 of FIGS. 1 and 2, except the moveable payload 116 includes a magnetic component 602, and the carrier 118 is arranged to accept the magnetic component 602. For example, the carrier 118 may have a cavity, or the like, arranged to accept the magnetic component 602 within. Further, the cup 120 is fabricated from a magnetically attractive material, as described above. In alternate embodiments, the moveable payload may include screw-type couplings 202 as shown in FIGS. 1, 2, 4, and 5, and described above as well as magnetic couplings as shown in FIGS. 6-11.

Figure 8:
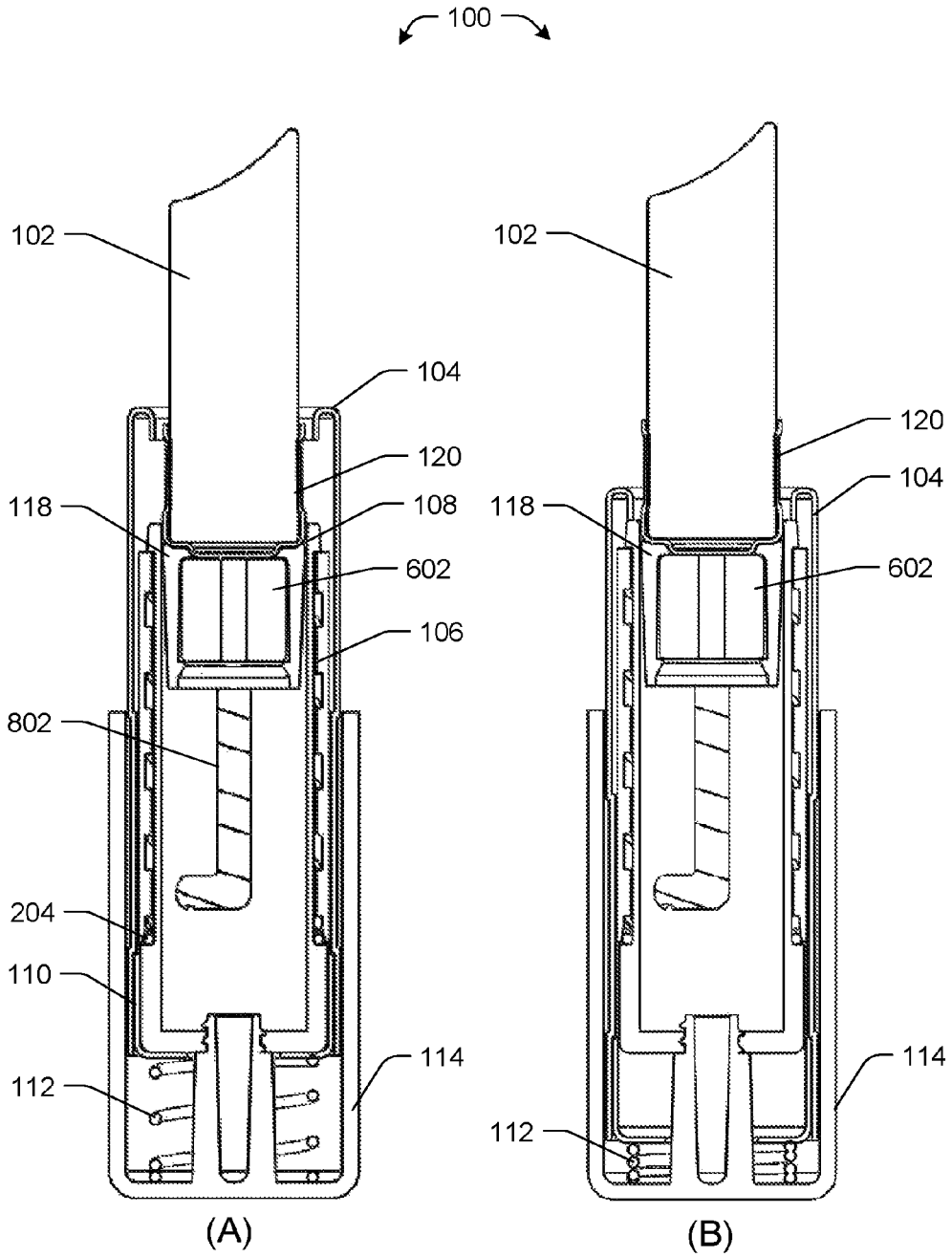
FIG. 8 includes two cross-sectional views of the example refillable lipstick dispenser of FIG. 6, with the lipstick refill fully extended for extraction of the refill, for example, and with the sleeve extended at (A) and the sleeve retracted at (B).

FIG. 8 includes two cross-sectional views of the example refillable lipstick dispenser 100 of FIG. 6, with the lipstick 102 fully extended for use or extraction, for example, and with the sleeve 104 extended at (A) and the sleeve 104 retracted at (B). As shown in FIG. 8, retracting the sleeve 104 provides greater access to the cup 120 for removal or installation of the lipstick 102.

For example, as described above, and shown in FIG. 8(B), the sleeve 104 may be retracted by sliding the sleeve 104 within the dispenser 100 (e.g., within the shell 114), compressing the spring 112. When the sleeve 104 is released, the spring 112 expands, extending the sleeve 104 to the rest position, as shown in FIG. 8(A). As shown in FIG. 8(A), when the sleeve 104 is extended (i.e., the rest position), most or all of the cup 120 is enclosed by the sleeve 104. As shown in FIG. 8(B) when the sleeve 104 is retracted, most or all of the cup 120 is exposed. Accordingly, installation and/or removal of the lipstick 102 via the cup 120 may be facilitated by retracting the sleeve 104.

In an implementation, the sleeve 104 may be temporarily locked in the retracted position. In one example, the retractable sleeve 104 includes one or more features on an inner surface of the retractable sleeve 104, and the spiral sleeve 106 includes one or more corresponding features on an outer surface of the spiral sleeve 106 (as shown in FIG. 1). In the example, the retractable sleeve 104 is locked into a retracted position by turning (i.e., rotating) the retractable sleeve 104 with respect to the spiral sleeve 106 when the retractable sleeve 104 is in the retracted position. Further, the sleeve 104 is released from the locked position by rotating the sleeve 104 in an opposite direction. In alternate embodiments, the sleeve 104 and/or other components of the dispenser 100, including the outer shell 114, for example, may include other or similar corresponding features to temporarily lock the sleeve 104 in a retracted position.

Figure 9:
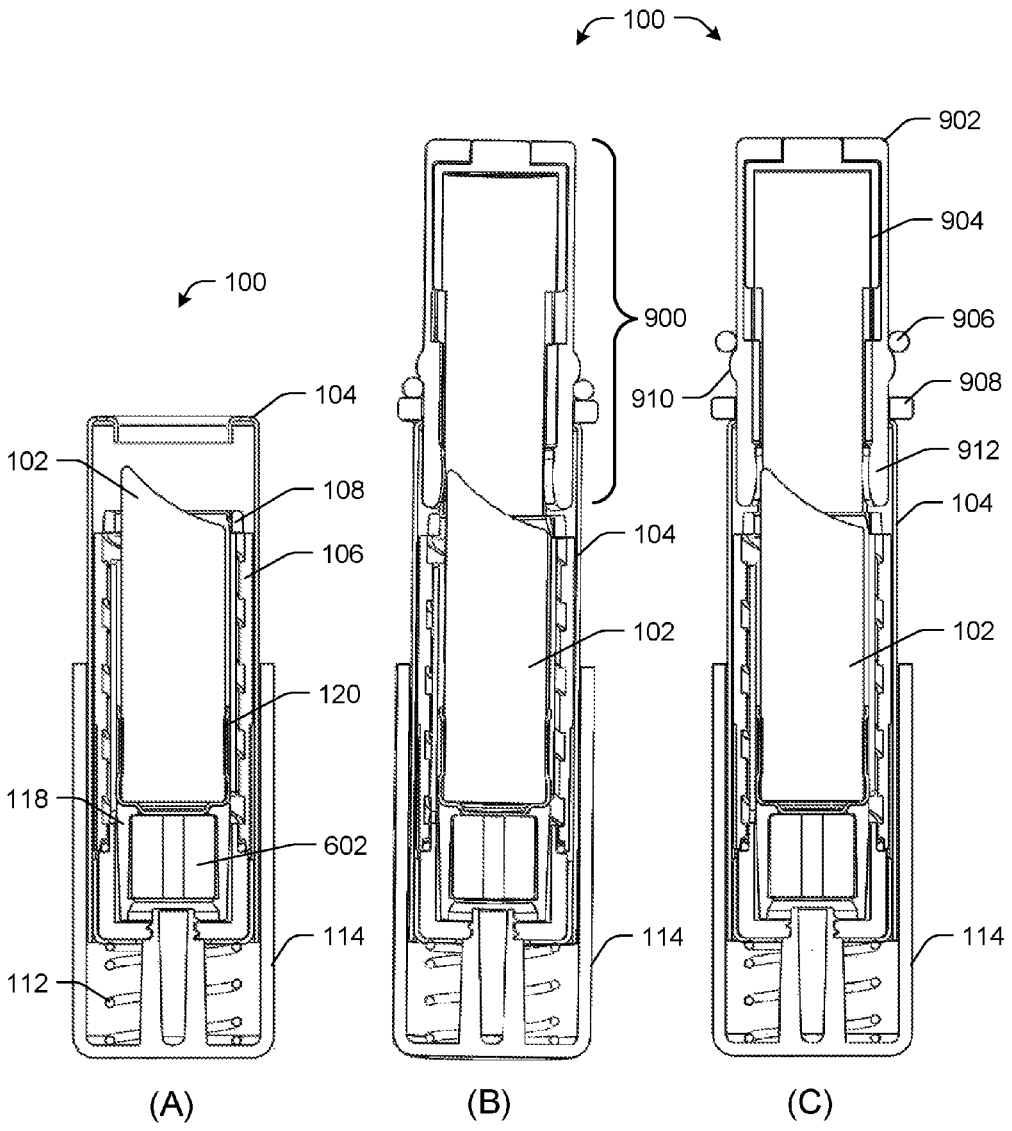
FIG. 9 shows the example dispenser of FIG. 6, in three views representing removal of the lipstick refill from the dispenser, according to the embodiment.
Figure 10:
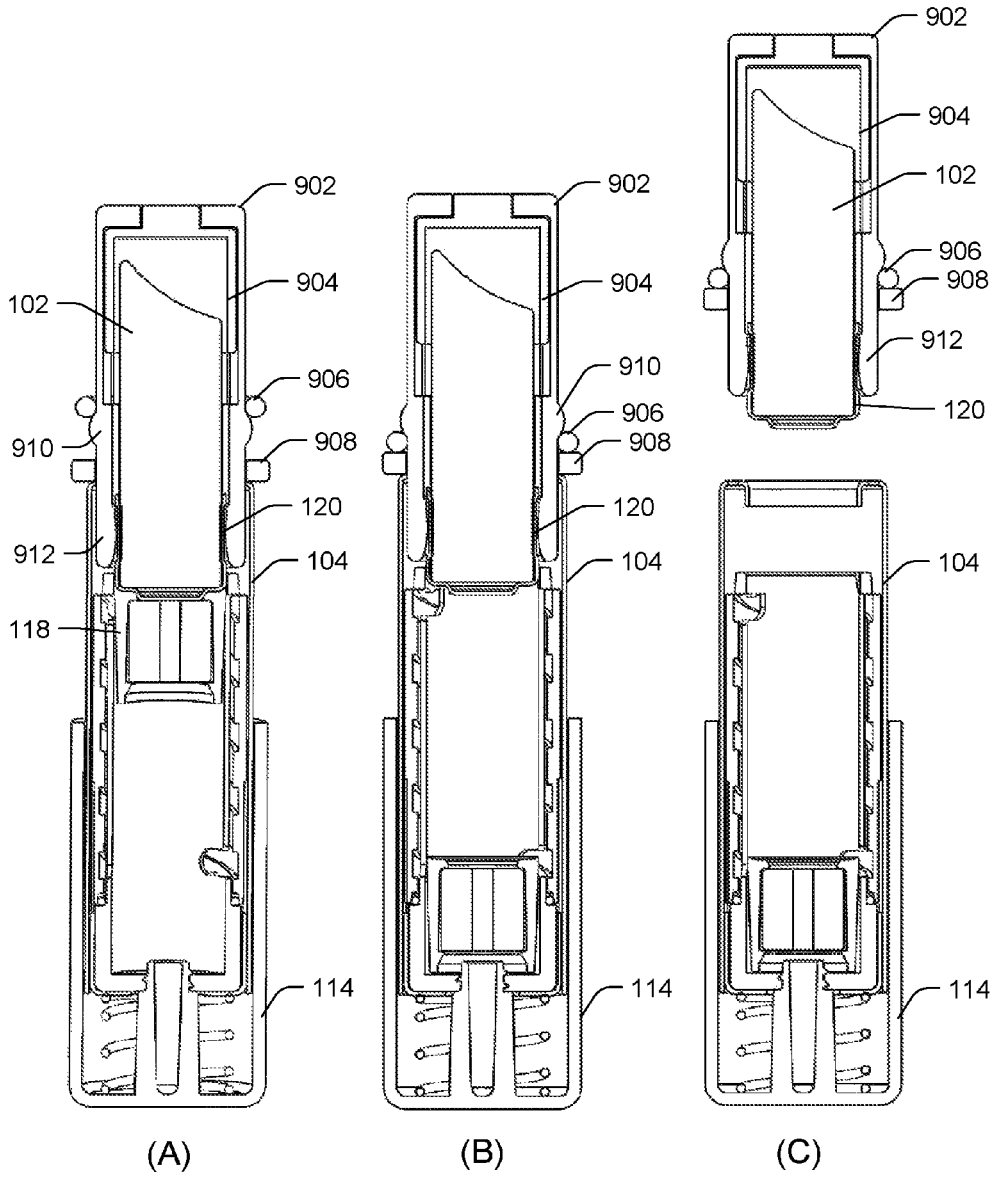
FIG. 10 shows the example dispenser of FIG. 6, in three more views representing removal of the lipstick refill from the dispenser, according to the embodiment.
Figure 11:
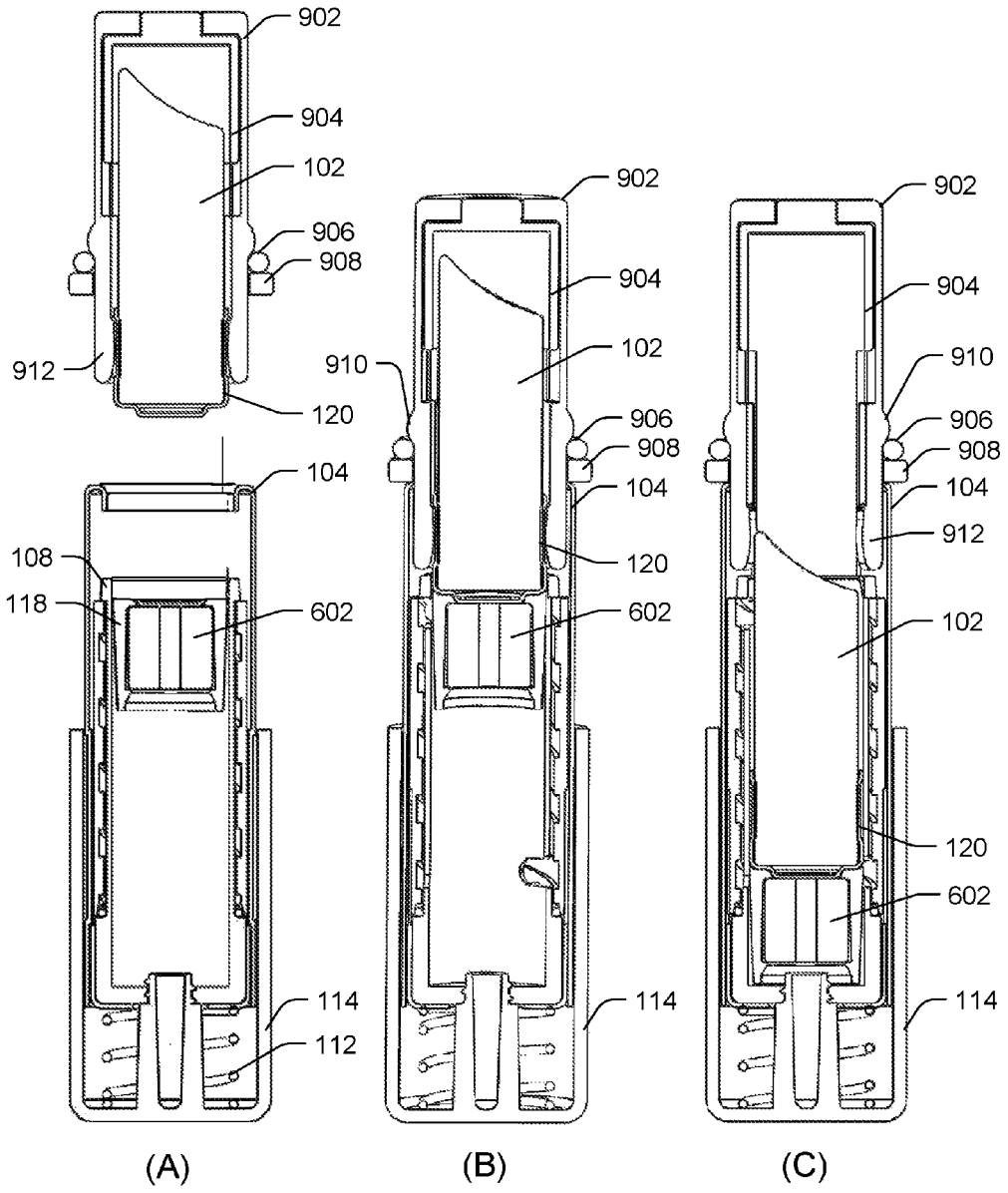
FIG. 11 shows the example dispenser of FIG. 6, in three views representing installation of a lipstick refill to the dispenser, according to an embodiment.
Figure 12:
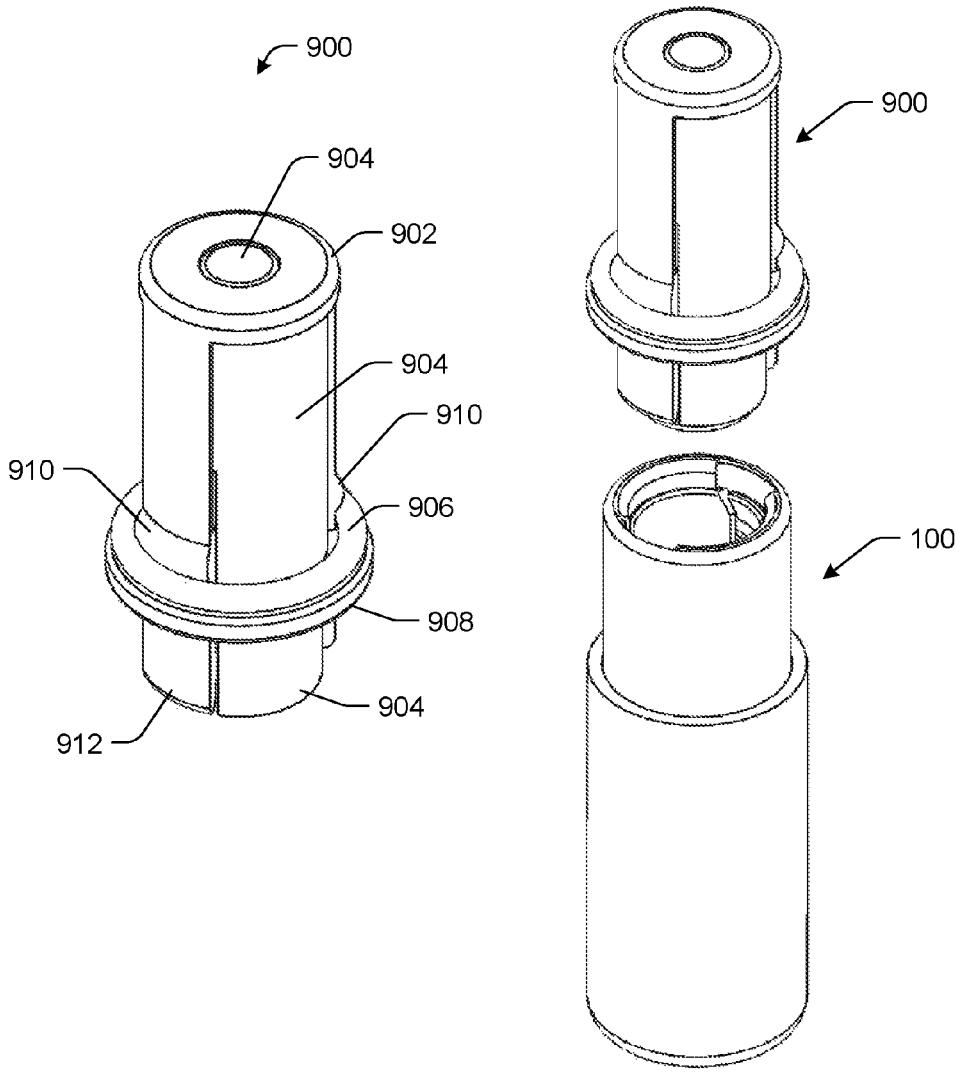
FIG. 12 is a diagram of an example extractor, and a view of the extractor positioned above an example dispenser, in preparation for installation of a lipstick refill, according to one example.
Figure 13:
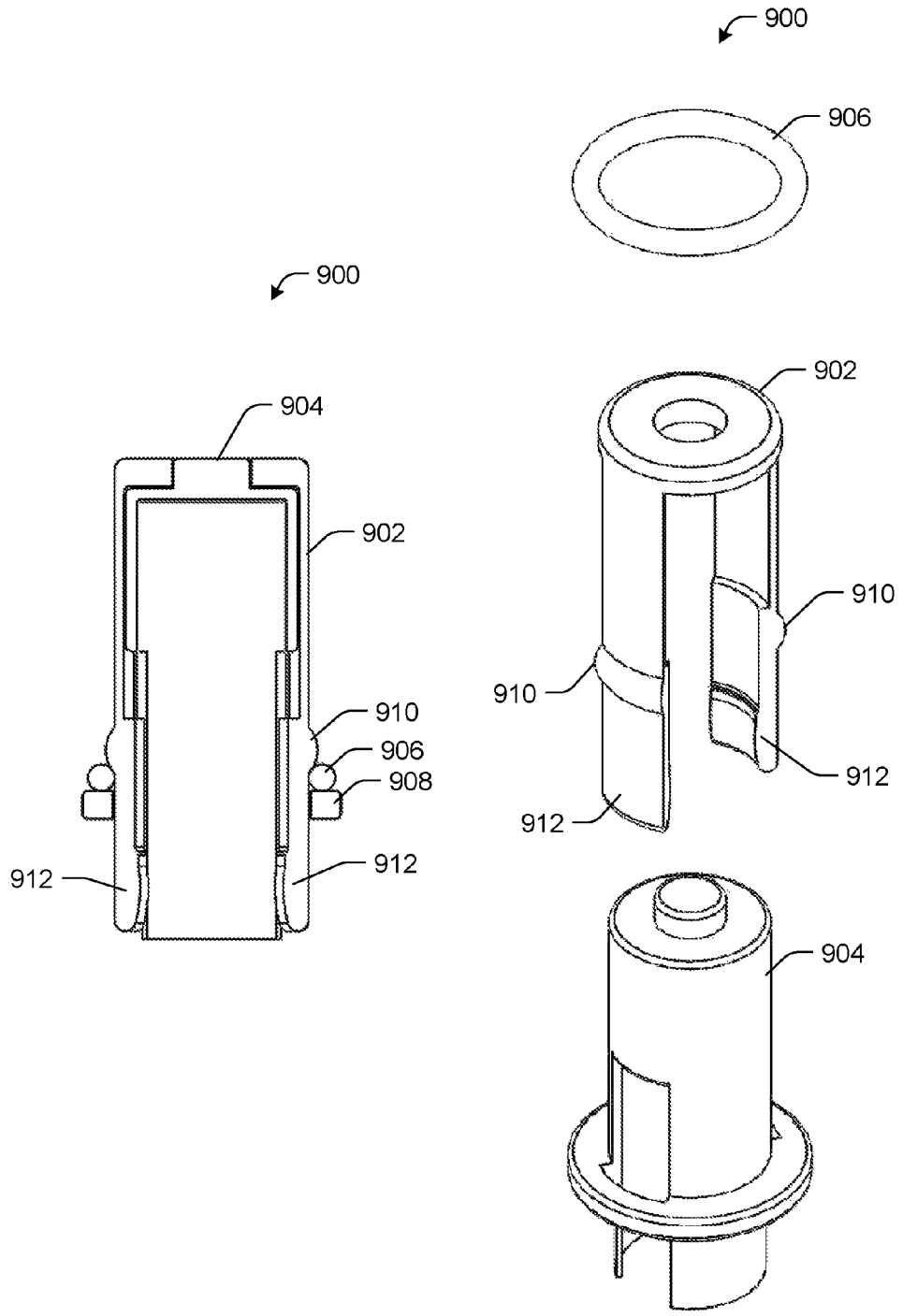
FIG. 13 is a cross-sectional view of the example extractor of FIG. 12, and an exploded view of the extractor, showing example components.

FIGS. 9 and 10 illustrate an example technique of removing a lipstick 102 from a dispenser 100, using an extractor 900 (see details of the extractor 900 at FIGS. 12 and 13). In various embodiments, a similar technique may be used to remove a lipstick 102 from a dispenser 100 using extractors of various designs, etc. Installation of a lipstick 102 into a dispenser 100 can be performed by following the technique in an opposite order, for example, and is illustrated in FIG. 11.

In an implementation, as shown in FIG. 9(A), a lipstick 102 is stored within a dispenser 100 in the retracted position. The working cap 122 is removed from the dispenser 100, in preparation for removal of the lipstick 102. In alternate implementations, the sleeve 104 may be extended (in a rest position as shown in FIG. 9) or retracted to remove the lipstick 102.

In the implementation, as shown in FIG. 9(B), an extractor 900 is placed on the dispenser 100, over the lipstick 102. In various implementations, the extractor may be set on the dispenser 100, snapped on, screwed on, or otherwise coupled to the dispenser 100. As detailed in FIGS. 12 and 13, and shown in FIG. 9(C), the example extractor 900 includes an outer portion 902, an inner portion 904 and a retainer (e.g., an O-ring, or the like) 906. In the example, the outer portion includes a flange 908, which may rest on the dispenser 100 (e.g., on the sleeve 104) when the extractor 900 is in position on the dispenser 100. Further, the jaws 912 of the extractor fit into the top of the dispenser 100 (e.g., fit into the sleeve 104, for example).

As shown in FIGS. 9(B) and 9(C), the retainer 906 is moved from a first position between the flange 908 and a ridge 910 on the outer portion 902, to a second position above the ridge 910, loosening a grip of the extractor 900. For example, while the retainer 906 is in the first position (as shown in FIG. 9(B)), the jaws 912 of the outer portion 902 are pressed inward by the retainer 906, and have a tighter grip. While the retainer 906 is in the second position (as shown in FIG. 9(C)), the jaws 912 are allowed to open, and have a looser grip.

As shown in FIG. 10(A), with the jaws 912 of the extractor 900 in a loosened position, the lipstick 102, in the carrier 118, is moved up to the fully extended position. The lipstick 102 is inserted into the extractor 900 as it is extended. The retainer 906 is moved into the first position, tightening the jaws 912 of the extractor 900 onto the cup 120, as shown in FIG. 10(B). The carrier 118 is lowered into the dispenser 100, breaking the connection (e.g., magnetic connection) between the cup 120 and the carrier 118. In an alternate example, the cup 120 (when fitted with a screw-type connector 202) is unscrewed from the carrier 118 by rotating the extractor 900 with respect to the dispenser 100 prior to lowering the carrier 118 within the dispenser 100.

As shown in FIG. 10(C), the extractor 900 is then removed from the dispenser 100, taking the lipstick 102 in the cup 120 with it (e.g., the extractor 900 maintains a grip on the cup 120 while the retainer 906 is in the first position). In an embodiment, the cup 120 includes one or more features (e.g., ridge, band, tab, trough, slot, notch, etc.) that the extractor 900 can grip to maintain a hold on the cup 120. In various implementations, the lipstick 102 may be stored within the extractor 900, or it may be placed into storage packaging, or the like.

FIG. 11 shows an example technique representing installation of a lipstick 102 into the dispenser 100, according to an embodiment. In an embodiment, installation is the reverse of removal. As shown in FIG. 11(A), the carrier 118 is moved to the top extended position within the dispenser 100 and the extractor 900 is moved into position over the dispenser 100, while the lipstick 102 and cup 120 are held within the extractor 900.

As shown in FIG. 11(B), the extractor 900 is positioned onto the dispenser 100 (and coupled to the dispenser 100 in some embodiments), with the jaws 912 inserted into the top of the dispenser 100 (into the sleeve 104, for example). The cup 120 is coupled to the carrier (by magnetic catch, screw-type connection, or other). The retainer 906 is moved to the second position, loosening the grip of the jaws 912 on the cup 120, and the carrier 118 is moved to the lowered (i.e., retracted) position within the dispenser.

FIG. 11(C) shows the carrier 118 (with the cup 120 and the lipstick 102) in the lowered position, and the retainer 906 moved back into the first position. The extractor may then be removed from the dispenser 100, since the lipstick 102 is installed. The carrier 118, magnet 602, cup 120, and lipstick 102 are fully enclosed within the tubular member 108 during retraction, and the working cap 122 can then be attached at the top to protect the lipstick 102.

FIG. 12 is a diagram of an example extractor 900, and a view of the extractor 900 positioned above an example dispenser 100, in preparation for installation of a lipstick 102, according to one example. FIG. 13 shows a cross-sectional view of the example extractor 900, and an exploded view of the extractor 900, showing example components. In various embodiments, the extractor 900 may include fewer, additional, or alternative components performing similar functions described herein, and remain within the disclosure.

In various implementations, the inner 904 and outer 902 extractor portions may be fabricated from a rigid to semi-rigid material (polymer, metal, etc.) such that at least the outer portion 902 is allowed to flex somewhat, providing a grip that can open to loosen and close to grip the cup 120. Further, the retainer 906 may be fabricated from a semi-rigid to semi-flexible material (vinyl, rubber, etc.) to allow the retainer 906 to be moved from the first position to the second position (e.g., some stretching or flexing), and to tighten the jaws 912 while in the first position (having a smaller diameter than a diameter of the extractor 900 when in a state of rest).

Figure 14:
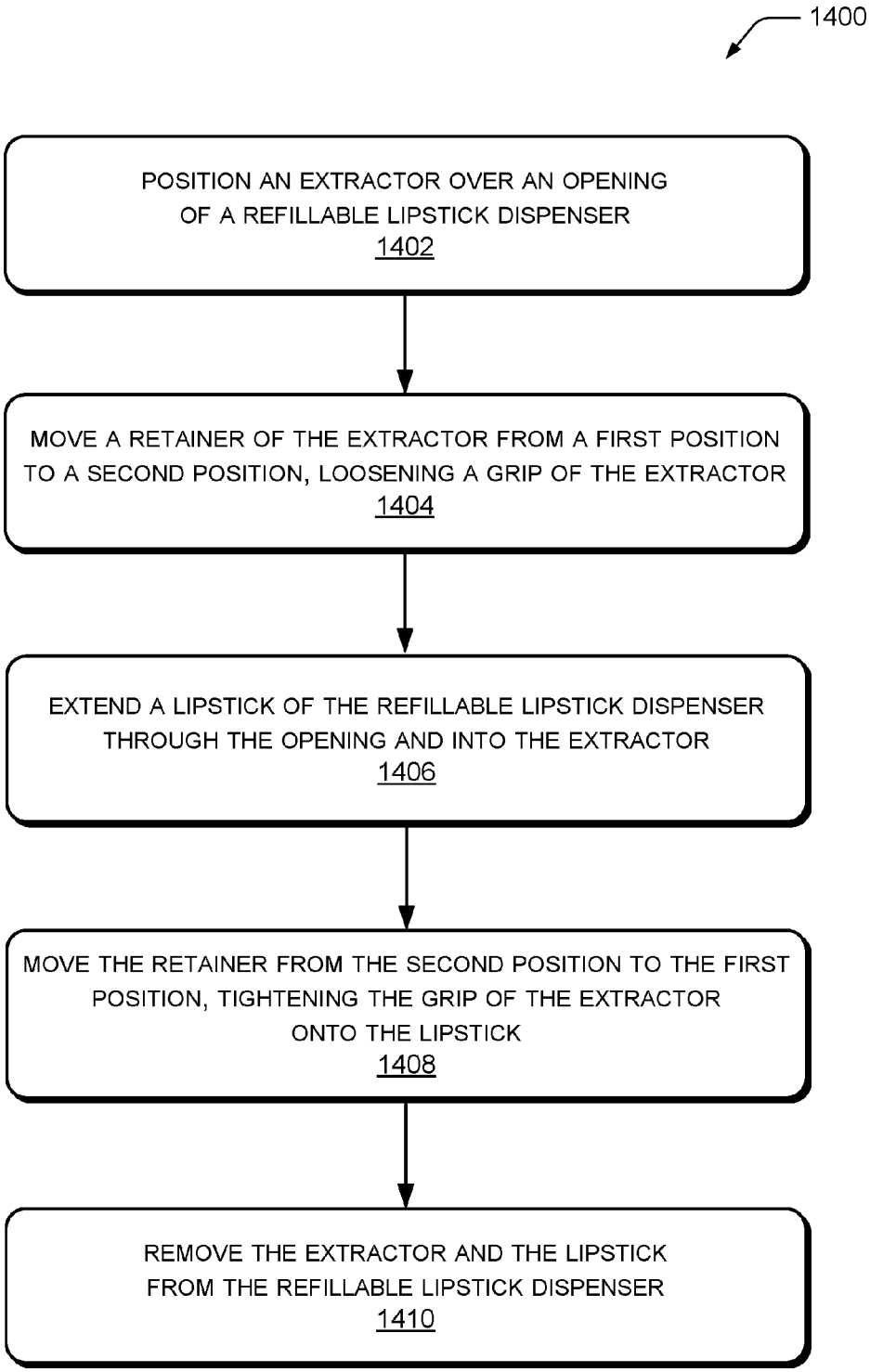
FIG. 14 is a flow diagram of an example method of removing a lipstick refill from a refillable lipstick holder. (opposite for installation)

FIG. 14 shows an example method 1400 of removing a refillable lipstick (e.g., 102) from a dispenser (e.g., 100) using an extractor (e.g., 900). An example method for installing a lipstick into a dispenser using the extractor may be had by reversing the steps listed. In the flow diagram, steps of the method are shown in individual blocks. The order of the blocks does not imply a required order for the steps of the example method 1400.

At block 1402, the method includes positioning an extractor over an opening of a refillable lipstick dispenser having a lipstick within the refillable lipstick dispenser. The method includes coupling the extractor to the refillable lipstick dispenser. For example, the extractor may be inserted partly into the refillable lipstick dispenser. In alternate implementations, the extractor may be snapped, screwed, or otherwise fitted to the opening of the refillable lipstick dispenser.

In an implementation, the method includes retracting a retractable sleeve of the refillable lipstick dispenser, and positioning the extractor within the retractable sleeve.

At block 1404, the method includes moving a retainer of the extractor from a first position to a second position, loosening a grip of the extractor. For example, the retainer may allow jaws of the extractor to open, so that the lipstick can enter the extractor unhindered, while in the second position.

At block 1406, the method includes extending the lipstick of the refillable lipstick dispenser through the opening and into the extractor. This may be performed by twisting the refillable lipstick dispenser, as if extending the lipstick for use, for example.

At block 1408, the method includes moving the retainer from the second position to the first position, tightening the grip of the extractor onto the lipstick. For example, the retainer may compress the jaws of the extractor against the lipstick, or against a holding cup of the lipstick, while in the first position.

At block 1410, the method includes removing the extractor and the lipstick from the refillable lipstick dispenser. In one implementation, the method includes releasing a lipstick cup coupled to the lipstick from a carrier of the refillable lipstick dispenser prior to removing the extractor from the refillable lipstick dispenser. For example, this may include unscrewing the lipstick cup from the carrier by rotating the extractor prior to removing the extractor from the refillable lipstick dispenser. In an alternate embodiment, this may include decoupling a magnetically attractive lipstick cup from a magnetized carrier, or the like.

In an implementation, the method includes a process for installing a lipstick into the refillable lipstick dispenser. For example, the method includes positioning a refill cap having a lipstick refill over the opening of the refillable lipstick dispenser. The method includes moving a carrier of the refillable lipstick dispenser to an extended (e.g., top) position within the refillable lipstick dispenser and retracting a retractable sleeve of the refillable lipstick dispenser, exposing a contact surface of the carrier. With the contact surface exposed, the method includes coupling a holding cup of the lipstick refill to the carrier. The coupling may include a screw-type coupling, a magnetic coupling, a bayonet fitting, etc.

In an implementation, the method includes extending the retractable sleeve, pushing the refill cap away from the lipstick refill. This loosens a grip of the refill cap on the lipstick refill. The method includes moving the carrier and the lipstick refill to a retracted position within the refillable lipstick dispenser and removing the (empty) refill cap from the refillable lipstick dispenser.

Conclusion

Although exemplary systems have been described in language specific to structural features and/or methodological acts, it is to be understood that the subject matter defined in the appended claims is not necessarily limited to the specific features or acts described. Rather, the specific features and acts are disclosed as exemplary forms of implementing the claimed systems, methods, and structures.

What is claimed is:

1. A refillable lipstick dispenser (100), comprising:

a tubular member (108);

a removable cup (120) within the tubular member (108) for holding a lipstick (102); and a retractable sleeve (104) arranged to enclose the tubular member (108) and to slide with respect to the tubular member (108) along an axis concentric to the tubular member (108), such that the retractable sleeve (104) encloses the removable cup (120) when in a first position and exposes at least a portion of the removable cup (120) when in a second position.

2. The refillable lipstick dispenser of claim 1, further comprising a spring component (112) arranged to compress when the retractable sleeve is in the second position, and to slide the retractable sleeve into the first position when released.

3. The refillable lipstick dispenser of claim 1, further comprising a refill cap (302) attachable to the retractable sleeve and capable of containing the removable cup and the lipstick.

4. The refillable lipstick dispenser of claim 3, wherein the retractable sleeve is arranged to push the refill cap away from the refillable lipstick dispenser when extended during installation of a lipstick to the refillable lipstick dispenser.

5. The refillable lipstick dispenser of claim 1, further comprising a carrier (118) moveably attached to the tubular member; and wherein the removable cup is removably attached to the carrier.

6. The refillable lipstick dispenser of claim 5, wherein the retractable sleeve is arranged to expose at least a coupling surface of the carrier when retracted during installation of a lipstick to the refillable lipstick dispenser.

7. The refillable lipstick dispenser of claim 5, wherein the removable cup is removably attached to the carrier by one of:

a screw-type connection (202); or a bayonet connection.

8. The refillable lipstick dispenser of claim 5, further comprising a magnet (602) arranged to movably attach the removable cup to the carrier.

9. The refillable lipstick dispenser of claim 5, wherein the carrier is extendible and retractable for extending and retracting the removable cup and the lipstick from an end of the tubular member.

10. The refillable lipstick dispenser of claim 5, further comprising a spiral sleeve having a spiral slot to create a swivel-up tubular member;

wherein the spiral slot contacts pins on the carrier for extending and retracting the carrier, the removable cup, and the lipstick when the spiral sleeve is rotated.

11. A refillable lipstick dispenser (100), comprising:

a tubular member (108) arranged to guide a lipstick (102) within the refillable lipstick dispenser;

a retractable sleeve (104) arranged to enclose the tubular member (108);

an extractor (900) arranged to be partially inserted within at least one of the tubular member (108) and the sleeve (104), and to extract the lipstick (102) from the refillable lipstick dispenser (100).

12. The refillable lipstick dispenser of claim 11, further comprising a spring component (112) arranged to return the retractable sleeve (104) to a rest position when released from a retracted position.

13. The refillable lipstick dispenser of claim 11, wherein the extractor comprises an outer portion (902), an inner portion (904) and a retainer (906) arranged to compress jaws (912) of the outer portion against the lipstick when the retainer is in a first position.

14. The refillable lipstick dispenser of claim 13, wherein the retainer is arranged to release a grip of the jaws on the lipstick when the retainer is in a second position.

15. The refillable lipstick dispenser of claim 14, further comprising a ridge (910) of the outer portion arranged to hold the retainer in either the first position or the second position.

16. A method (1400), comprising:

(1402) positioning an extractor over an opening of a refillable lipstick dispenser having a lipstick within the refillable lipstick dispenser;

(1404) moving a retainer of the extractor from a first position to a second position, loosening a grip of the extractor;

(1406) extending the lipstick of the refillable lipstick dispenser through the opening and into the extractor;

(1408) moving the retainer from the second position to the first position, tightening the grip of the extractor onto the lipstick; and (1410) removing the extractor and the lipstick from the refillable lipstick dispenser.

17. The method of claim 16, further comprising coupling the extractor to the refillable lipstick dispenser.

18. The method of claim 16, further comprising retracting a retractable sleeve of the refillable lipstick dispenser, and positioning the extractor within the retractable sleeve.

19. The method of claim 16, further comprising releasing a lipstick cup coupled to the lipstick from a carrier of the refillable lipstick dispenser prior to removing the extractor from the refillable lipstick dispenser.

20. The method of claim 19, further comprising unscrewing the lipstick cup from the carrier by rotating the extractor prior to removing the extractor from the refillable lipstick dispenser.

21. The method of claim 16, further comprising:

positioning a refill cap having a lipstick refill over the opening of the refillable lipstick dispenser;

moving a carrier of the refillable lipstick dispenser to an extended position within the refillable lipstick dispenser;

retracting a retractable sleeve of the refillable lipstick dispenser, exposing a contact surface of the carrier;

coupling a cup of the lipstick refill to the carrier;

extending the retractable sleeve, pushing the refill cap away from the lipstick refill;

moving the carrier and the lipstick refill to a retracted position within the refillable lipstick dispenser; and removing the refill cap from the refillable lipstick dispenser.

* * * * *